United States Patent [19]

De-La-Concha-Caceres

[11] Patent Number: 4,535,983

[45] Date of Patent: Aug. 20, 1985

[54] RECREATIONAL DEVICE FOR PRODUCING THE THRILL OF A FREE FALL

[75] Inventor: Alfonso De-La-Concha-Caceres, Mexico City, Mexico

[73] Assignee: Free Motion Designs Corporation, Houston, Tex.

[21] Appl. No.: 484,997

[22] Filed: Apr. 14, 1983

[30] Foreign Application Priority Data

Apr. 15, 1982 [MX] Mexico ..... 192281
Mar. 23, 1983 [MX] Mexico ..... 196685

[51] Int. Cl.[3] ..... A63G 31/00
[52] U.S. Cl. ..... 272/6
[58] Field of Search ..... 272/1 R, 2, 6, 8 R, 272/16, 24; 182/138, 139; 273/1 GG

[56] References Cited

U.S. PATENT DOCUMENTS

| | | | |
|---|---|---|---|
| 896,213 | 8/1908 | Kerfoot | 182/138 |
| 1,088,826 | 3/1914 | Labady | 182/138 |
| 3,484,953 | 12/1969 | Norheim, Jr. | 272/2 UX |
| 3,578,320 | 5/1971 | Goldfarb et al. | 273/1 GG |
| 3,701,528 | 10/1972 | Ryan | 272/6 |

FOREIGN PATENT DOCUMENTS

| | | | |
|---|---|---|---|
| 2701138 | 7/1978 | Fed. Rep. of Germany | 182/138 |

OTHER PUBLICATIONS

Baggett, James A., "You Float on Air in this New-Sport Flight Chamber", *Popular Science Monthly*, vol. 222, No. 3, Feb. 15, 1983, p. 61.

*Primary Examiner*—Richard T. Stouffer
*Attorney, Agent, or Firm*—Fleit, Jacobson, Cohn & Price

[57] ABSTRACT

A recreational device for producing the thrill of a free fall on the users, which includes a housing, a shock absorbing cushion throughout the bottom of the housing, and an inwardly extending peripheral deck on the top of the housing. The deck has an area sufficient to accommodate a predetermined number of persons and arranged to provide a launching platform for allowing persons to jump into the housing. A plurality of elastic bands have their two opposite ends fixedly attached to the interior surfaces of the side walls of the housing, each individual elastic band extending in a horizontal position throughout its length across the housing. The elastic bands are randomly arranged at different levels within the housing to form an elastic network leaving spans between the bands which are sufficiently small to prevent a person jumping from the deck into the housing from passing through the network all the way down through the housing without bouncing on one or more of the elastic bands, but with the elastic bands having an elasticity sufficient to permit persons to rebound on them as they fall from a higher level of bands to a lower level of bands. The elastic bands are arranged throughout at least a substantial part of the height of the housing. A part of the elastic bands may be arranged in the form of horizontal nets fixed on a frame which may be moved upwardly and downwardly to increase or decrease the vertical distance between successive elastic bands. The frames may also be circular and the housing correspondingly cylindrical to permit rotation of said frames.

13 Claims, 4 Drawing Figures

FIG. 3
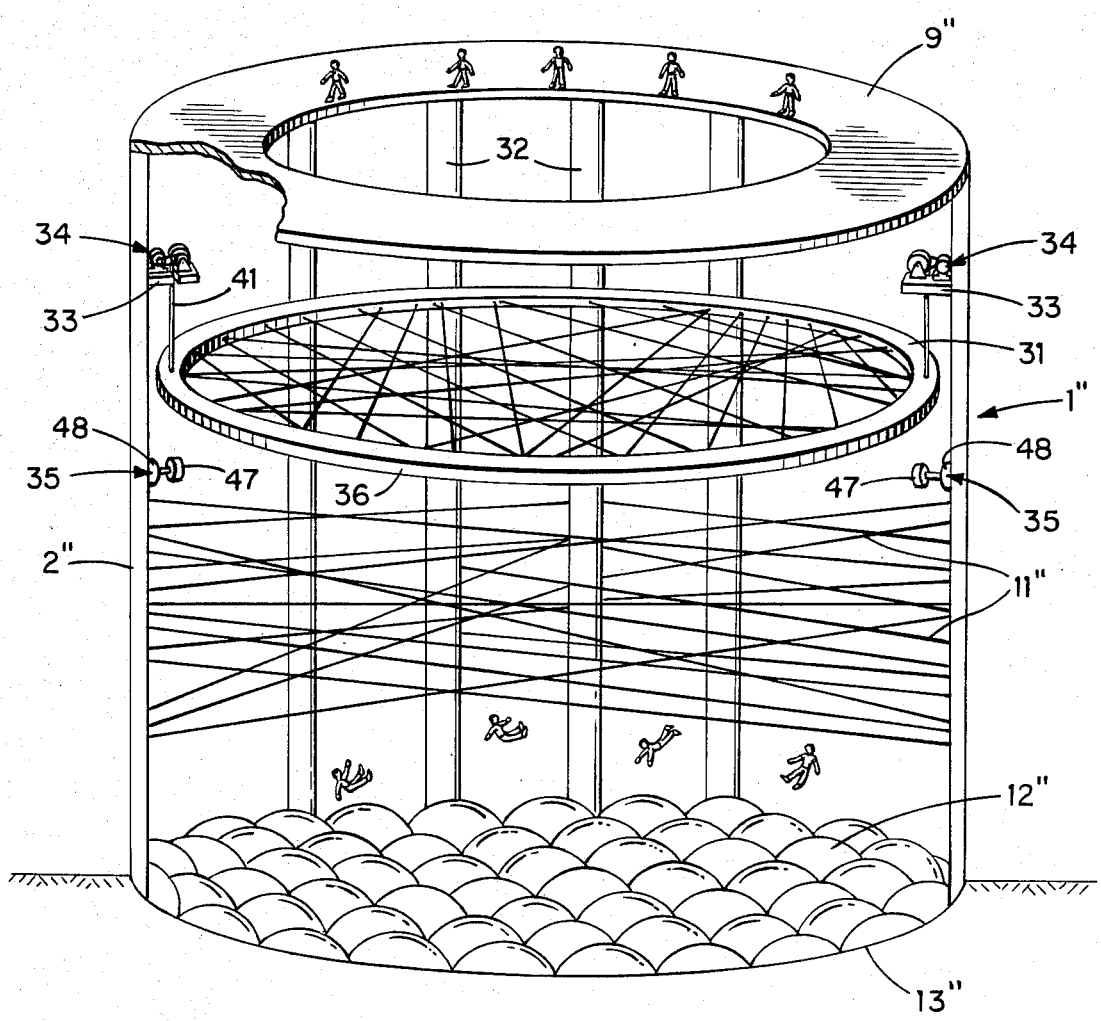
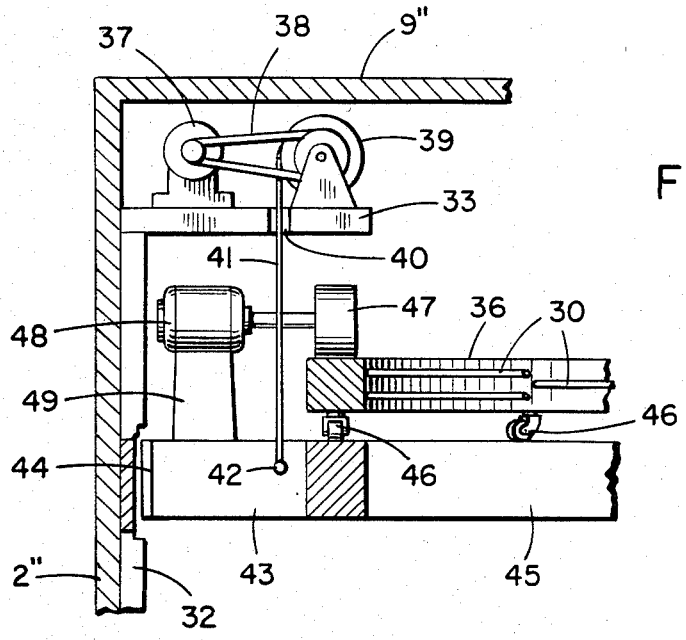
FIG. 4

RECREATIONAL DEVICE FOR PRODUCING THE THRILL OF A FREE FALL

FIELD OF THE INVENTION

The present invention refers to a recreational device and, more particularly, it is related with a recreational device for enabling persons to jump into a free fall which is arrested by a plurality of elastic bodies interposed in the path of the fall of said person.

BACKGROUND OF THE INVENTION

In the prior art recreational devices, there are numerous devices by means of which the fall of a person is permitted from a predetermined high point down to a predetermined low point, either by means of a slope, be it dry or provided with water for permitting the user to slip down along the same and there are also a plurality of devices in which the users may jump and slip over a pipe of the type utilized by firemen, but up to the present time, to the knowledge of applicant, there is no one single recreational device which may permit an absolutely free fall, that is, which may produce the thrill and sensation that the user is jumping into free space, inasmuch as all the devices of the prior art are provided with means for permitting said falls without losing contact at any moment with a steady structure on which the users slip down. The sensation of a free fall is, as any psychologist may clearly affirm, absolutely different from a supported fall, whereby the thrill caused to the users by a free fall is of a totally distinct nature, and a device which may simulate an entirely free fall, may be very much more thrilling than those in which the falls are made in constant contact with a solid surface.

Up to the present time, no recreational device has been created in which the user may feel the sensation of an entirely free fall, whereby the field of thrilling sought in the prior art amusement campus has left much to desire, because up to the present time no recreational device for producing the sensation of an entirely free fall has been created and said device has been for long sought.

BRIEF SUMMARY OF THE INVENTION

Having in mind the defects of the prior art recreational devices, it is an object of the present invention to provide a recreational device for producing free but arrested falls, which may be of a very simple construction and yet may cause in the user the sensation of an entirely free fall.

It is another object of the present invention to provide a recreational device of the above mentioned character, which will produce a highly thrilling sensation on the users and which will, however, provide a safe operation, avoiding undue shocks to the users even if the body of the users be accidentally placed in an inconvenient position during the fall.

One other object of the present invention is to provide a recreational device of the above mentioned character which may either increase or decrease the distance of free fall between a plurality of elastic objects interposed in the path of fall of the user, said elastic devices being movable either rotationally or vertically.

One more particular object of the present invention is to provide a recreational device of the above mentioned nature, which will have at least one bed of elastic bands which is movable either rotationally or vertically, in relation to a plurality of randomly distributed elastic bands.

The above objects, as well as other objects and advantages ancillary thereto, are accomplished as follows:

In accordance with a preferred embodiment of the invention, a recreational device is provided for producing the sensation of a free fall which is arrested by a plurality of elastic bodies, and which essentially comprises a vertical housing having a suitable height, said housing being provided externally with stairways or labyrinths for the users, as well as a deck having a suitable protection such as a fence or the like to avoid accidental falls, on its outer perimeter, and arranged at a suitable height such that the users may step thereon almost contiguously to the roof of the housing, in order to jump into the housing, said housing being provided, in all its cross section, with a plurality of elastic bands interiorly fixed to the sidewalls thereof, said elastic bands being arranged horizontally in random directions and at different levels, such that there is no possibility of an entirely free fall of the users from said deck to the bottom of the housing, and being also provided with a suitable shock absorbing cushion, which may be pneumatic or may be made of soft foam rubber, arranged throughout the area of the bottom of said housing, in order to absorb any accidental shock of the users who jump to come down rebounding on succesive elastic bands. At the interior of the housing, a helical slope may be provided communicating said deck with an opening situated directly above said shock absorbing cushion.

In accordance with another embodiment of the invention, at least part of the elastic bands is arranged on a bed, by means of the provision of a frame to which a net of said elastic bands is attached, said frame being arranged such that it may be lifted or lowered by means of suitable hoists and guided by means of suitable tracks, so as to change the vertical distance of the elastic bands of said bed from the randomly distributed elastic bands throughout the interior of the housing. The housing may be made circular in cross section and the frame may also be made annular, and may be supported on a secondary fixed frame, so as to be able to be rotated in order to increase the thrill of the recreational device.

BRIEF DESCRIPTION OF THE DRAWINGS

The features that are considered characteristic of the present invention will be set forth with particularity in the appended claims. The invention itself, however, both as to its organization and its method of operation, together with other objects and advantages thereof, will best be understood from the following description of specific embodiments, when read in connection with the accompanying drawings, in which:

FIG. 3 is a diagrammatic perspective view of a recreational apparatus for producing free but arrested falls, built in accordance with a third embodiment of the invention; and FIG. 4 is a cross-sectional elevational view of the mechanism for moving the beds of elastic bands of a fourth embodiment of the invention.

Figure 1:
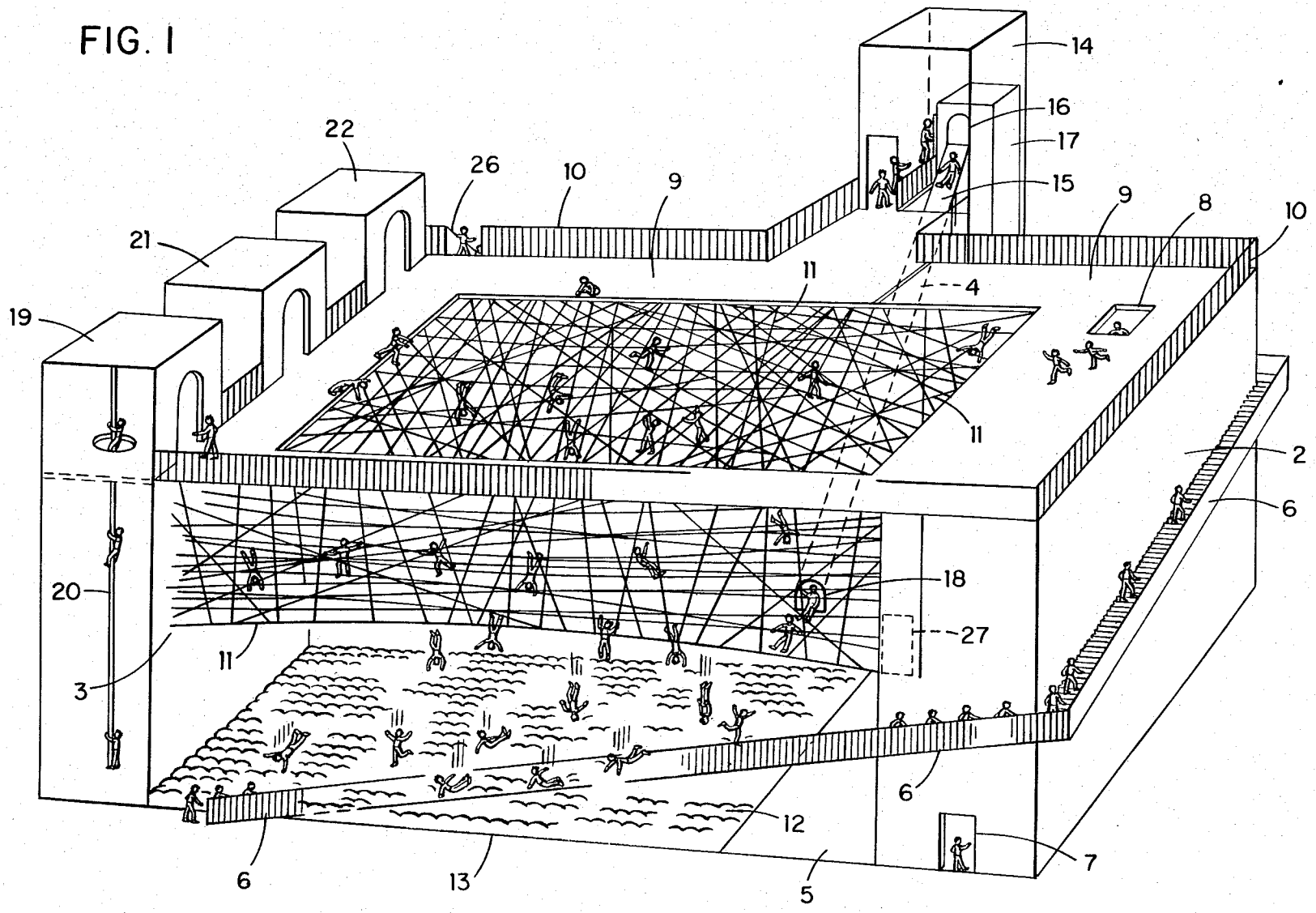
FIG. 1 is a diagrammatic perspective view of a recreational device for producing free but arrested falls, built in accordance with a first embodiment of the present invention, with parts broken away to show inner details thereof.

Having now more particular reference to the drawings and more specifically to FIG. 1 thereof, there is shown a recreational apparatus for producing free but arrested falls which essentially comprises a housing 1, which may be of any suitable shape at the election of the designer, but which in the particular instance of the embodiment illustrated in figure one of the drawings is a rectangular housing 1, having side walls 2 and 3 and extreme walls 4 and 5, all of said walls being vertically arranged in order to form a room having a suitable height, and around which walls there is installed a stairway or ramp 6, through which the users may go up to use the device through entrance 26, for passing unto a deck or platform 9, protected by means of a fence 10 in order to avoid any accidental fall of the users outwardly of the housing, such that all the users going up through ramp 6, may stand on the deck 9 and may jump into the interior space of the housing 1, wherein a plurality of randomly distributed horizontal elastic bands 11 is arranged, said bands being arranged with random directions and at random levels but suitably precalculated and predesigned in order to avoid, with an absolute margin of safety, that an entirely free fall of the users from deck 9 to the floor 13 may be produced and such that, when the users jump into the space from deck 9, they will at the same time have the thrilling of an entirely free fall, said fall being arrested at different levels by the elastic bands 11, on which the user bounces until he reaches a pneumatic or soft cushion 12, which cushion has a sufficient thickness to protect the users against any accidental fall, either for breakage of any elastic bands or in view of the fact that the position that his body may adopt during the fall, might render said fall on the floor 13 to occur in an inconvenient position, whereby the cushion 12 may save the user of any painful accident, thereby constituting an absolute safety device.

The recreational apparatus built in accordance with the above embodiment of the invention, may be completed, if desired, by the provision of a tower 14, which may be arranged preferably on the exterior of wall 4 but which may also be arranged in the interior of the housing, and which is provided with a stairway from the deck 9 into the smaller tower 17 and out of the window 16 at more elevated level, through which the users may slip downwardly on a helical slope schematically illustrated by the reference numeral 15, in order to slip down over the same down to the exit 18, to fall over the shock absorbing safety cushion 12. Once the device has been used, the users may move themselves over the cushion 12 to reach the side passage, thereby exiting the housing through the outlets 27.

An additional series of towers may be provided, such as towers 19, 21 and 22, within which various types of recreational devices may be contained, for example, slip pipes of the type used by firemen and illustrated under reference numeral 20, the tower 19, for instance, being built with walls of transparent acrylic material, such that the persons which observe the housing may watch the descent of the users, whereas towers 21 and 22 may be covered by opaque material and a series of lights of the stroboscopic or intermittent type may be installed, or said towers may be totally obscure or may contain a sound system in order to cause different sensations and thrills on the users.

Figure 2:
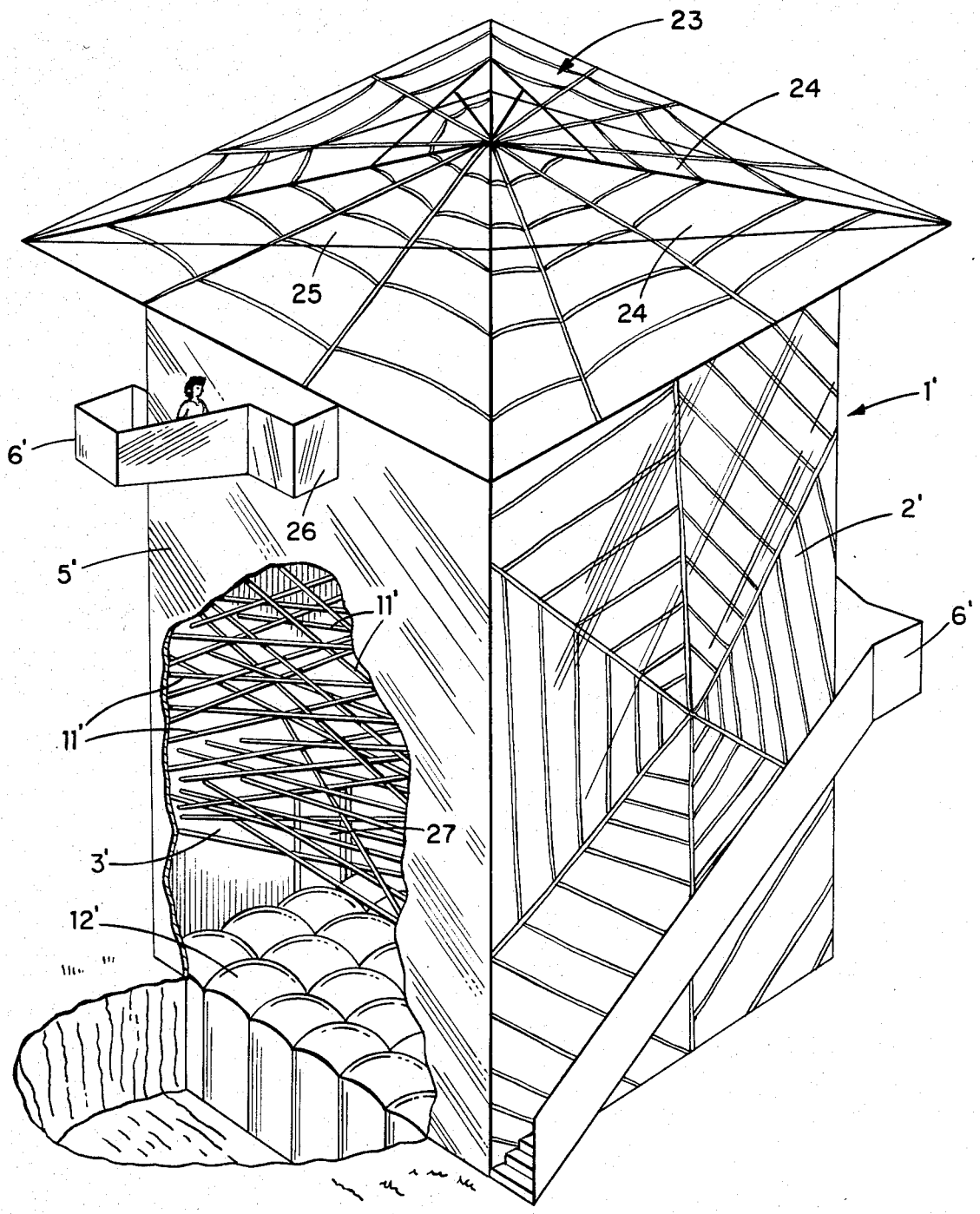
FIG. 2 is a perspective diagrammatic view of a second embodiment of a recreational device built in accordance with this invention.

Having now more particular reference to FIG. 2 of the drawings, the embodiment of the invention shown in this figure is practically the same as the embodiment illustrated in FIG. 1. It may be seen, however, that the housing 1' is covered by means of a dome or roof 23, which may be built in sections such as sections 24 and 25, said sections being capable of being closed or opened at will, either for having light from the exterior to flood the housing, or to cancel the entrance of light into the housing totally or partially, whereby intermittent lights may be installed for causing diverse emotions and effects on the users. Otherwise, the embodiment of FIG. 2 is exactly the same and works in identical manner than the embodiment illustrated in FIG. 1 of the drawings, that is, both are provided with devices which produce the effect sought by the present invention, namely, the sensation of a free fall by the provision of a plurality of elastic bands 11', horizontally and randomly arranged on the interior of the walls of the housing, and with their positions, directions and levels randomly selected but suitably designed in order to avoid entirely free falls from deck 9' to cushion 12', and in order to cause the rebounding of the users, each time at a lower level, so as to produce an arrested fall of the user until the same reaches the cushion 12' which is at the level of the floor.

Having now more particular reference to FIG. 3 of the drawings, there is shown a modified embodiment of the recreational apparatus for producing free but arrested falls, which also comprises the housing 1" but said housing, in this particular case, is preferably of a cylindrical form in order to permit the rotation of the beds 31 of elastic bands 30, and the housing is also provided with the plurality of randomly distributed horizontal elastic bands 11", throughout the height of the housing 1" and fixed to its wall 2", and also contains a plurality of elastic bands 30 arranged in the form of at least one bed 31 of elastic bands, such as illustrated on the upper portion of the housing 1" in the embodiment shown in FIG. 3 of the drawings.

A plurality of hoist mechanisms 34 is also provided supported on projections 33 at suitable positions, in order to lift or lower at least one of said beds of elastic bands, such as illustrated at 31 in FIG. 3 of the drawings, and at least a rotational mechanism 35 is also provided in order to rotate the bed 31 of elastic bands 30.

The rotative mechanism 35 may be fixed on the interior of the wall 2" of the housing 1", in order to rotate the bed 31 of elastic bands 30 in one single position in its height, such as illustrated in FIG. 3 of the drawings, or may be built as a mechanism which may move in unison with the bed 31 of elastic bands 30, such as illustrated in FIG. 4 of the drawings, in order to be able to rotate said bed 31 on any position thereof along the height of the housing 1", on which it may be situated or moved by the hoist mechanism 34, as will be explained more fully hereinbelow.

When the bed 31 of elastic bands 30 is separated from the rotative mechanism 35 and the latter is fixed on the wall 2" of housing 1", then said bed of elastic bands merely comprises a circular frame 36, vertically guided by a plurality of guides 32 and the hoist mechanisms 34 lift or lower the said circular frame by means of cables 41, and by hoisting on the frame 36 of the bed 31. In this manner, when the hoist 41 operates for lifting the bed, in order to situate the said bed 31 of elastic bands at an intermediate height between its lower and its upper position, such as illustrated in FIG. 3 of the drawings, then the rotative mechanism 35 will be separated from the frame 36, and said bed 31 will be fixed in its rotating position on the housing, that is, will not be rotated in relation to said housing. The bed 31 of elastic bands 30 may be rotated by means of the rotative mechanism 35, when the hoist mechanism 34 lowers the same to a suitable position for enabling the friction roll 37 of said rotative mechanism 35, to abut against the lower face of the frame 36, whereby the motor of the mechanism 35 will rotate the bed 31 such as will be apparent for anyone skilled in the art.

The mechanism assembly for lifting or lowering the bed of elastic bands, as well as for rotating the same, may be built in accordance with what is illustrated more clearly in FIG. 4 of the drawings, such that the rotation of bed 31 of elastic bands 30 may be effected at any height on which the hoist mechanism 34 may locate the same, by having the rotative mechanism 31 to be also liftable, that is, by having said mechanism to be internally joined to the bed 31, whereby the assembly of mechanisms is arranged, such as illustrated more clearly in FIG. 4 of the drawings, in the following manner.

On the wall 2'' of the housing 1'' of the apparatus built in accordance with this embodiment of the invention, the plurality of guides 32 is provided, of which only one is illustrated in FIG. 4, and within which the rotating mechanism 35 is guided, said rotative mechanism essentially comprising a motor 48 provided with a special base 49 which engages the same to the guide plate 43 engaged to a non rotating frame 45, such that the action of the hoist 34, when lifting said frame 45 of bed 31 of elastic bands 30, will also lift in unison the rotating mechanism 35.

Motor 48 of the rotating mechanism 35, through its shaft, rotates the friction roll 47, which bears on the frame 36 of bed 31, said frame 36 being supported on the non rotative frame 45 through a plurality of rolls 46 which permit the same to rotate with respect to the other, in order to rotate the elastic bands 30 which form a net by being fixed to the rotative frame 36. In other words, when the hoist 34 is operated, the total assembly of the rotative mechanism 35 and the bed 31 is lifted guided by the flanges 44 of the guide plate 43, which run along the guides 32, located in various points throughout the circumference of the housing 1'', such as illustrated in FIG. 3.

The hoist mechanism 34, in turn, comprises a motor 37 arranged under the deck 9'', and said motor, by means of a suitable band 38, moves a pulley 39 which in turn lifts or lowers the cable 41 which passes through the projection 33 on which the hoist is mounted, by means of a suitable bore 40, and is joined to the guide plate 43 on the point 42, or may be joined to the other part of bed 31 in order to lift or lower the same at will, together with the rotating mechanism 35.

In the particular instance of the embodiment illustrated in FIG. 4, the frame 36 must be rotatively supported throughout the circumference of the housing 1'' and, for this purpose, the non rotating frame 45 is provided firmly attached to the guide plates 43, said frame 45 being provided with the above mentioned plurality of idle rolls 46, on which the circumferential rotatable frame 36 is supported.

In this manner, the frame 36 will be rotated by rolling on the rolls 46 and the complete bed unit 31 will be rotated at any height in which the same may be located. In this particular instance, cable 41 of hoist 34 will pull from the fixed frame 45, such as illustrated more clearly in FIG. 4 of the drawings, in order to permit the rotation of the movable frame 36, and the guide plate 43 will be attached to the fixed frame 45, such as is also illustrated in FIG. 4 of the drawings, in order to leave complete freedom of rotation to the movable frame 36.

From the above it may be seen that for the first time a recreational apparatus has been provided which, contrary to all prior art recreational apparatus for causing falls of the users, will produce a totally different sensation and thrill on the users, inasmuch as the apparatus of the present invention is built in such a manner that the user jumps into the empty space from a deck placed at a considerable height, thus having the thrill of being thrown to the said empty space, that is, without the support of any solid or rigid surface, and its fall is suitably arrested and the thrill is still increased by the rebounding of the user against the elastic bands 11'' and/or 30, which are provided throughout the inner area of the housing, at different levels which cause the user to descend in a free fall from band to band, either rebounding on said elastic bands or hanging from the same, until he reaches the shock absorbing cushion placed at the bottom of the device where the journey terminates.

The thrill may be considerably increased by providing a plurality of elastic bands arranged in beds which may be movable in an upward or downward direction, as well as in a rotational direction, whereby the users may gain a more thrilling effect when falling down the housing of the recreational device of the present invention.

The main difference between the recreational device of the present invention and all the prior art recreational devices, is that the same is provided with means to produce an entirely free unsupported fall, which is arrested from time to time by elastic members, which is in opposition to the fall supported by a solid surface, during all the time of said fall, as is provided by all the recreational device of the prior art.

Although certain specific embodiments of the present invention have been shown and described, it must be pointed out that many modifications thereof are possible. Therefore, the present invention is not to be regarded as restricted, except insofar as is required by the prior art and by the spirit of the appended claims.

What is claimed is

1. A recreational device for producing the thrill of a free fall on the users and comprising in combination a housing having a bottom, tall side walls and an open top, a shock absorbing cushion extending throughout the area of the bottom of said housing, an inwardly extending peripheral deck at the open top of said housing, a plurality of elastic bands having their two ends fixed on the interior surface of the side walls of said housing, each individual elastic band extending in a horizontal position across said housing, said elastic bands being randomly arranged within said housing such that a person jumping from said deck into said housing cannot fall all the way down without bouncing on one or more of said elastic bands prior to reaching said shock absorbing cushion, said elastic bands being arranged throughout at least a substantial part of the height of said housing, a frame, at least part of said plurality of elastic bands form a horizontal net within said frame, and hoist means engage said frame for moving the same up and down the side walls of said housing.

2. A recreational device according to claim 1 wherein said housing is of a cylindrical shape and means are included for rotating said frame in any direction within the housing.

3. A recreational device according to claim 2 wherein said means for rotating said frame comprise a non rotatable frame attached to said hoist means, a plurality of rollers on the uper surface of said non rotatable frame, a rotatable frame to which said elastic bands are attached, and a rotating drive means mounted on said non rotatable frame and engaged to said rotatable frame for rotating the same.

4. A recreational device according to claim 2 wherein said means for rotating said frame comprise a plurality of rotating drive means mounted on the side wall of said housing and capable of engaging the undersurface of said frame when the hoist means lower the same to its lowermost position.

5. A recreational device according to claim 1 wherein said means for moving said frame comprise a plurality of hoists arranged at the top of said housing under said peripheral deck, means for engaging said hoists to said frame, and a plurality of guiding means for guiding the vertical movement of said frame, arranged on the interior surfaces of the side walls of said housing.

6. A recreational device according to claim 1 wherein a roof is arranged at a distance above said peripheral deck at the top of said housing.

7. A recreational device according to claim 6 wherein said roof is formed by a plurality of roof sections, and means are included for opening and closing individual desired ones of said roof sections.

8. A recreational device according to claim 7 wherein a light and sound system is included within said housing for producing light and sound effects during the fall of the users.

9. A recreational device according to claim 8 wherein a plurality of towers are provided externally of the side walls of said housing, each of said towers including an additional amusement for the users who elect not to make the free fall from said deck, said additional amusements comprising solid means through which the users may return to the floor of the device.

10. A recreational device for producing the thrill of a free fall on the users and comprising in combination a housing having a bottom, tall side walls and an open top, a shock absorbing cushion extending throughout the area of the bottom of said housing, an inwardly extending peripheral deck located at the open top of said housing, said deck having an area sufficient to accommodate a predetermined number of persons and including a launching area for allowing said persons to jump into said housing, and a plurality of elastic bands having their two opposite ends fixedly attached to the interior surfaces of the side walls of said housing, each individual elastic band extending in a horizontal position throughout its length across said housing, said elastic bands being randomly arranged at different levels within said housing to form an elastic network leaving spans between said bands which are sufficiently small to prevent a person jumping from said deck into said housing from passing through said elastic network all the way down through said housing except by bouncing on one or more said elastic bands, said elastic bands having an elasticity sufficient to permit said persons to rebound thereon as they fall from a higher level of bands to a lower level of bands, said elastic bands being arranged throughout at least a substantial part of the height of said housing.

11. A recreational device according to claim 10, wherein a roof is arranged at a distance above said peripheral deck at the top of said housing, said roof being formed by a plurality of roof sections, and means are included for opening and closing individual desired roof sections.

12. A recreational device according to claim 11, wherein a light and sound system is included within said housing for producing light and sound effects during the fall of the users.

13. A recreational device according to claim 10, further comprising a frame, at least part of said elastic bands are arranged to form a horizontal net within said frame, and hoist means are provided engaging said frame for moving the frame up and down the side walls of said housing.

* * * * *